US005634480A

United States Patent [19]

Lu

[11] Patent Number: 5,634,480

[45] Date of Patent: Jun. 3, 1997

[54] STRUCTURE OF HAIR CLIP

[76] Inventor: Chaio-Lan Lu, P.O. Box 372, Hsin-Chu, Taiwan

[21] Appl. No.: 673,089

[22] Filed: Sep. 1, 1996

[51] Int. Cl.[6] ..... A45D 8/24

[52] U.S. Cl. ..... 132/275; 24/487; 132/279

[58] Field of Search ..... 132/270, 275, 132/278, 279, 273, 276, 277; 24/487, 499, 545

[56] References Cited

U.S. PATENT DOCUMENTS

| | | | |
|---|---|---|---|
| 3,412,739 | 11/1968 | Thatcher | 132/278 |
| 3,805,813 | 4/1974 | Laughton | 132/279 |
| 5,445,170 | 8/1995 | Yasuda | 132/278 |
| 5,546,966 | 8/1996 | Lin | 132/276 |

*Primary Examiner*—Todd E. Manahan
*Assistant Examiner*—Eduardo C. Robert

[57] ABSTRACT

A hair clip is made from an elongated metal plate by stamping. The hair clip comprises a base plate section, a clamping plate section, a hinge section connected between the base plate section and the clamping plate section, a retaining section extending from one end of the clamping plate, and a catch plate raised from the base plate section at one end remote from the hinge section. The retaining section has a V-shaped profile with retaining holes and the catch plate has two substantially C-shaped pawls which engage the retaining holes of the retaining section to secure the clamping plate section in the clamping position.

10 Claims, 12 Drawing Sheets

STRUCTURE OF HAIR CLIP

BACKGROUND OF THE INVENTION

The present invention relates to hair clips, and relates more particularly to such a hair clip which is integrally made from an elongated resilient metal plate by stamping.

A variety of hair clips have been disclosed for use to fasten the hair, and have appeared on the market. These hair clips commonly comprise a base plate, a clamping plate hinged to one end of the base plate by hinge means, and a retainer means fixedly secured to the base plate at one end remote from the hinge means and adapted to hold the free end of the clamping plate when the hair clip is fastened to the hair. Because these conventional hair clips are complicated of several parts, their manufacturing process is complicated and consumes much labor.

SUMMARY OF THE INVENTION

The present invention has been accomplished to provide a hair clip which eliminates the aforesaid drawbacks. According to one aspect of the present invention, the hair clip is integrally made from an elongated metal plate by stamping, comprising a base plate section, a clamping plate section, a hinge section connected between the base plate section and the clamping plate section, a retaining section extending from one end of the clamping plate and having a V-shaped profile with retaining holes, and a catch plate raised from the base plate section at one end remote from the hinge section and having two substantially C-shaped pawls at the two adapted for engaging the retaining holes of the retaining section to secure the clamping plate section in the clamping position. According to another aspect of the present invention, the retaining section has two outward finger strips at two opposite sides through which the retaining section can be conveniently deformed by fingers and forced into engagement with the catch plate. According to still another aspect of the present invention, the base plate section has two lugs at two opposite ends adapted for mounting an ornamental plate to decorate the hair clip. According to still another aspect of the present invention, the clamping plate section and the base plate section have a respective set of teeth longitudinally disposed at two opposite sides for acting against each other to hold down the hair.

DETAILED DESCRIPTION OF THE PREFERRED EMBODIMENT

Figure 1:
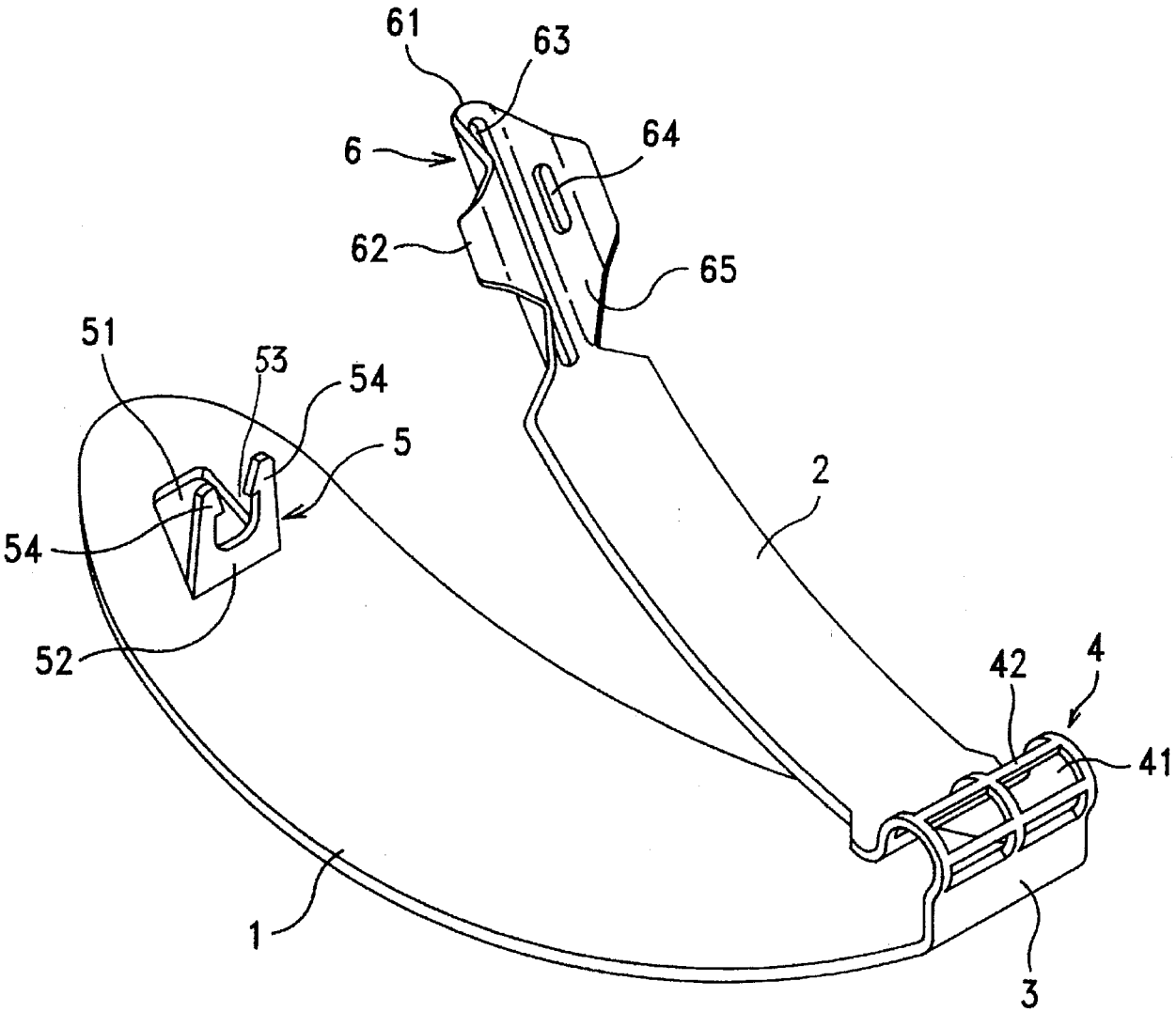
FIG. 1 is an elevational view of a hair clip according to a first embodiment of the present invention.
Figure 2:
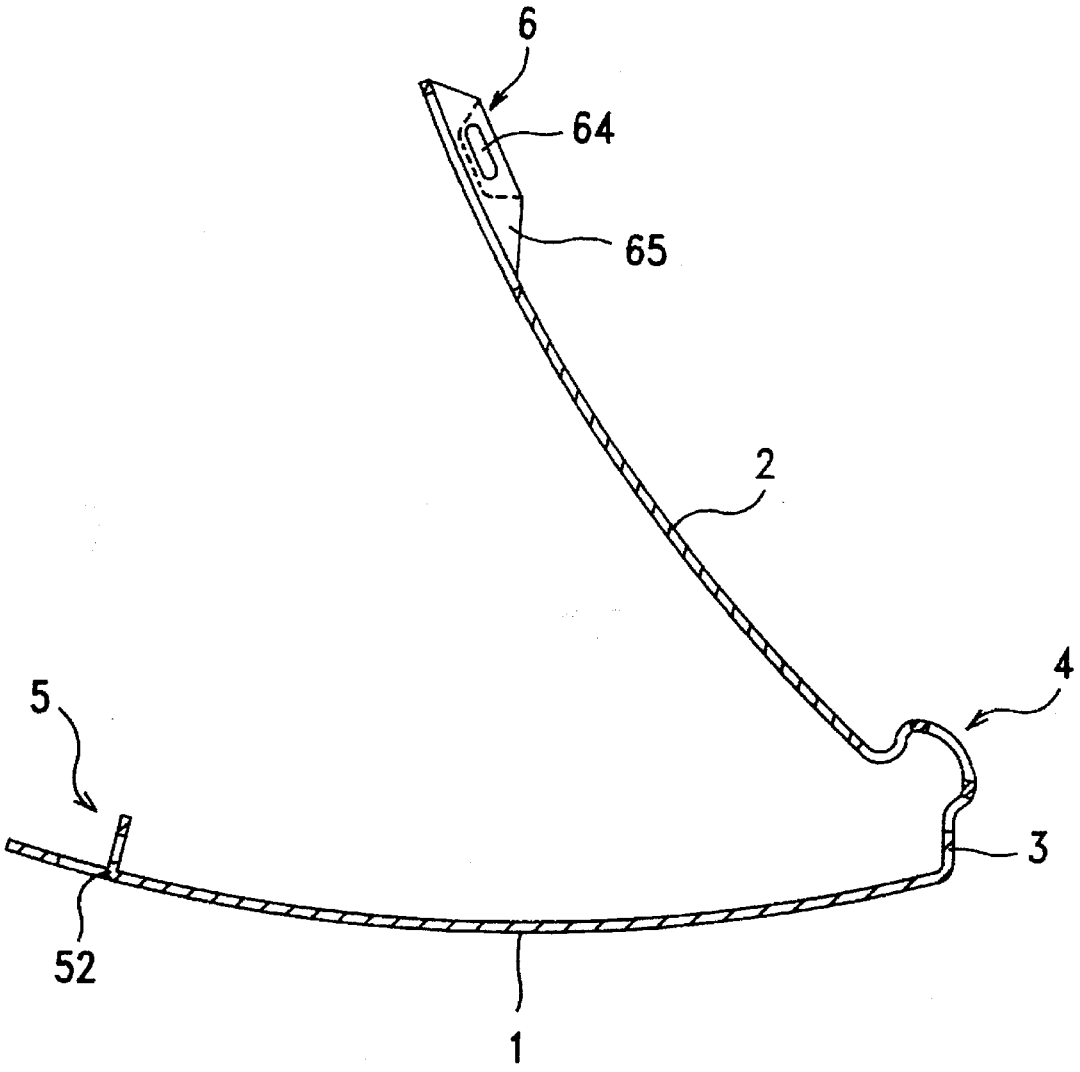
FIG. 2 is a sectional view of the hair clip shown in FIG. 1.

Referring to FIGS. 1 and 2, a hair clip in accordance with a first embodiment of the present invention is made from an elongated metal spring plate by stamping, comprising a base plate section 1, a first upright end plate section 3 raised from one end of the base plate section 1 at right angles, a clamping plate section 2, a hinge section 4 connected between the first upright end plate section 3 and the clamping plate section 2, and a retaining section 6 longitudinally extending from one end of the clamping plate section 2 remote from the hinge section 4. A catch plate 5 is raised from the base plate section 1 at one end remote from the first upright end plate section 3. The catch plate 5 is integrally made from the material of the base plate section 1 by stamping. An opening 51 is formed in the base plate section 1 when the catch plate 5 is made. The catch plate 5 comprises an upright base wall portion 52 connected to one side of the opening 51, and two substantially C-shaped pawls 54 bilaterally raised from the upright base wall portion 52 at the top and facing each other, and a mouth 53 defined between the C-shaped pawls 54. The hinge section 4 is comprised of a plurality of intersected ribs 42 defining a plurality of slots 41. The retaining section 6 comprises a substantially V-shaped base wall portion 61, two outward finger strip portions 62, two coupling wall portions 65 bilaterally connected between the base wall portion 61 and the finger strip portions 62, an elongated slot 63 in the middle of the base wall portion 61, and a retaining hole 64 in each coupling wall portions 65. Because of the design of the elongated slot 63, the V-shaped base wall portion 61 can be deformed and then quickly returned to its former shape when the pressure is released.

Figure 3:
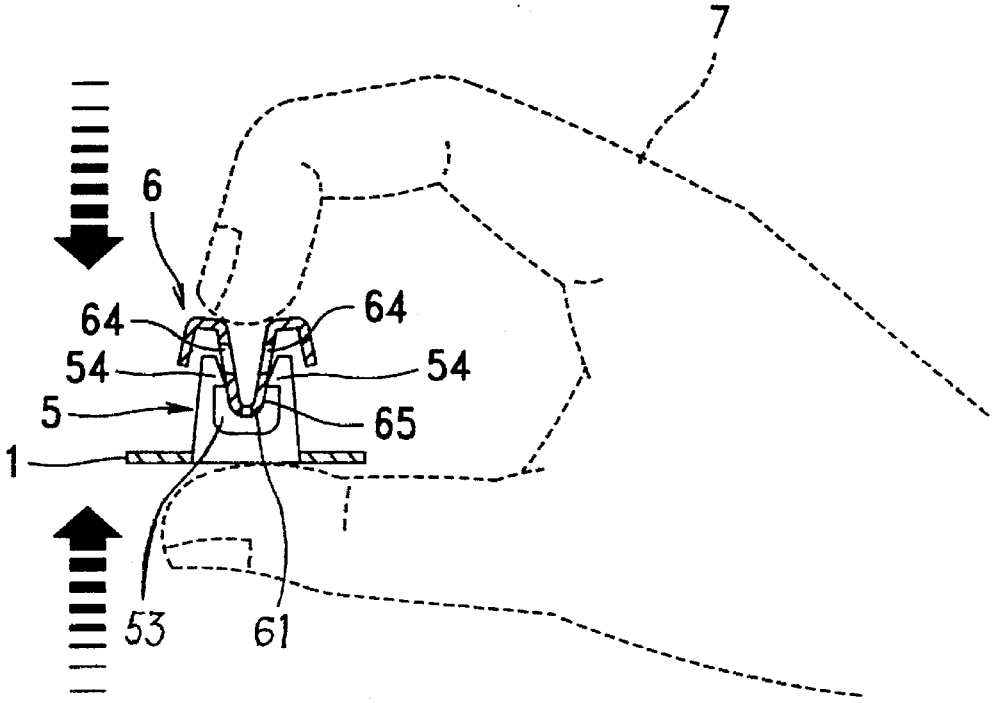
FIG. 3 is an end view in section of the first embodiment of the present invention, showing the V-shaped base wall portion of the retaining section forced into the mouth of the catch plate.
Figure 4:
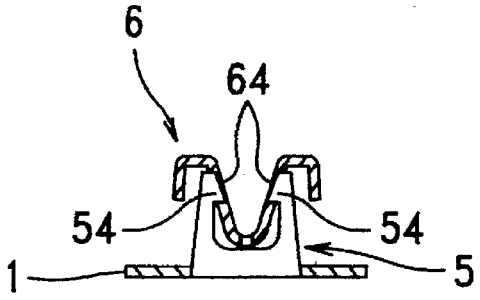
FIG. 4 is another end view in section of the first embodiment of the present invention, showing the retaining holes of the coupling wall portions of the retaining section engaged with the C-shaped pawls of the catch plate.
Figure 6:
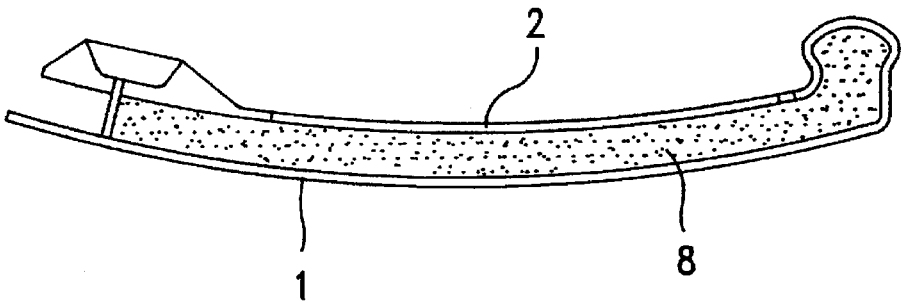
FIG. 6 is an applied view of the first embodiment of the present invention, showing the hair clip fastened to the hair.

Referring to FIGS. 3 and 4, when the clamping plate section 2 is turned toward the base plate section 1, the V-shaped base wall portion 61 of the retaining section 6 is forced into the mouth 53 of the catch plate 5. When the V-shaped base wall portion 61 of the retaining section 6 is forced into the mouth 53 of the catch plate 5 and released from the hands, the retaining holes 64 of the coupling portions 65 are respectively forced into engagement with the C-shaped pawls 54 of the catch plate 5, and therefore the hair clip is fastened up. FIG. 6 shows the clamping plate section 2 closed on the base plate section 1 and the hair clip fastened to the hair 8.

Figure 5:
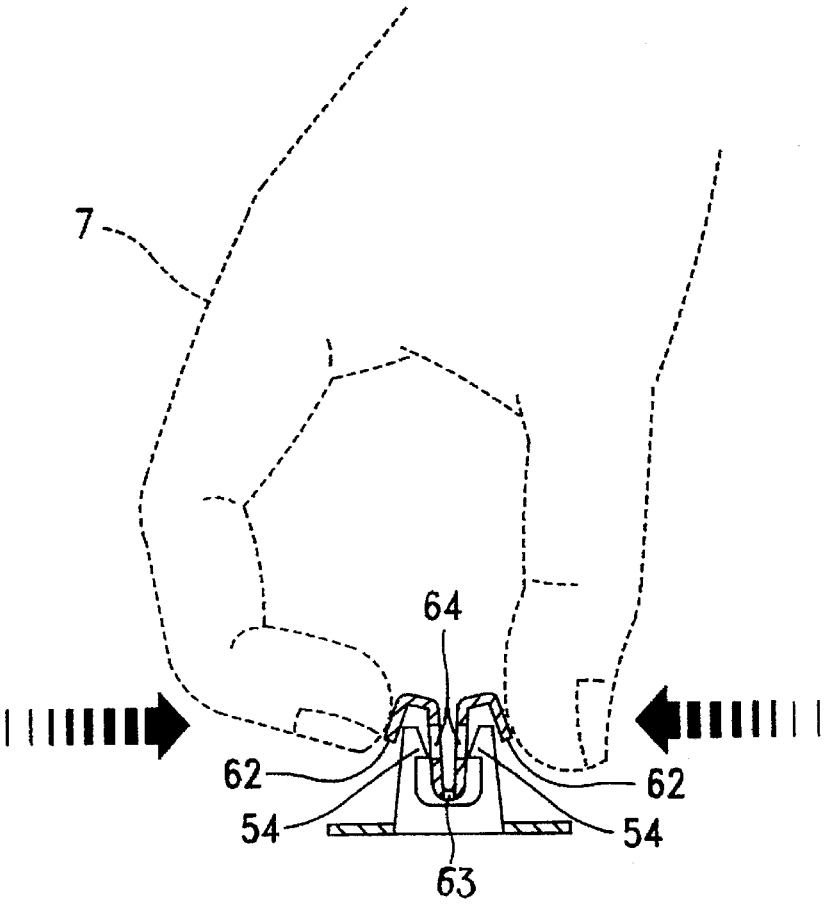
FIG. 5 is still another end view in section of the first embodiment of the present invention, showing the finger strip portions squeezed inwards, and the retaining holes of the coupling wall portions disengaged from the C-shaped pawls.

Referring to FIG. 5, when the outward finger strip portions 62 are squeezed inwards by the hand 7, the retaining holes 64 of the coupling wall portions 65 are disengaged from the C-shaped pawls 54 of the catch plate 5, therefore the retaining section 6 is disconnected from the catch plate 5, and the hair clip is unfastened.

Figure 7:
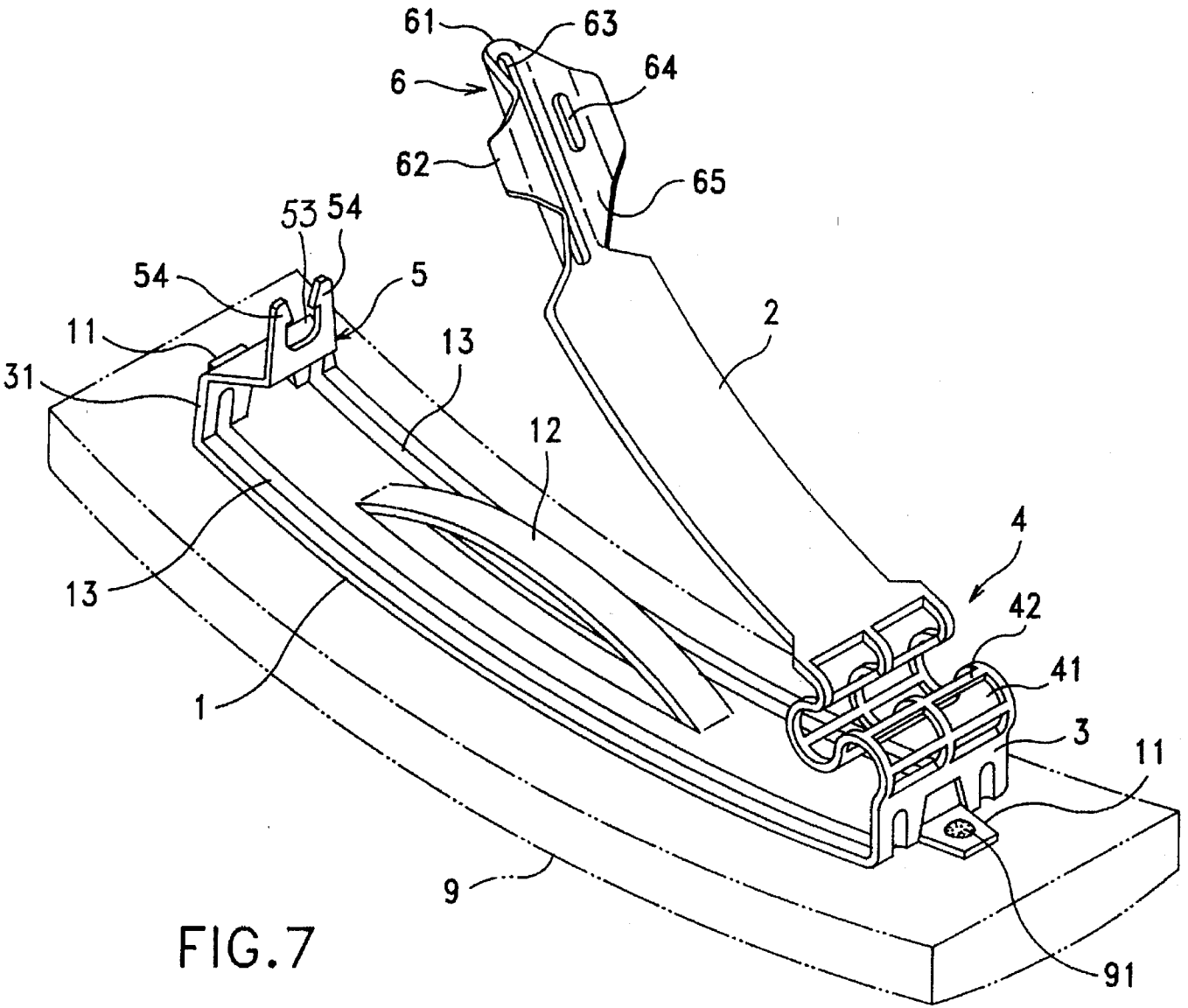
FIG. 7 is an elevational view of a hair clip according to a second embodiment of the present invention.
Figure 8:
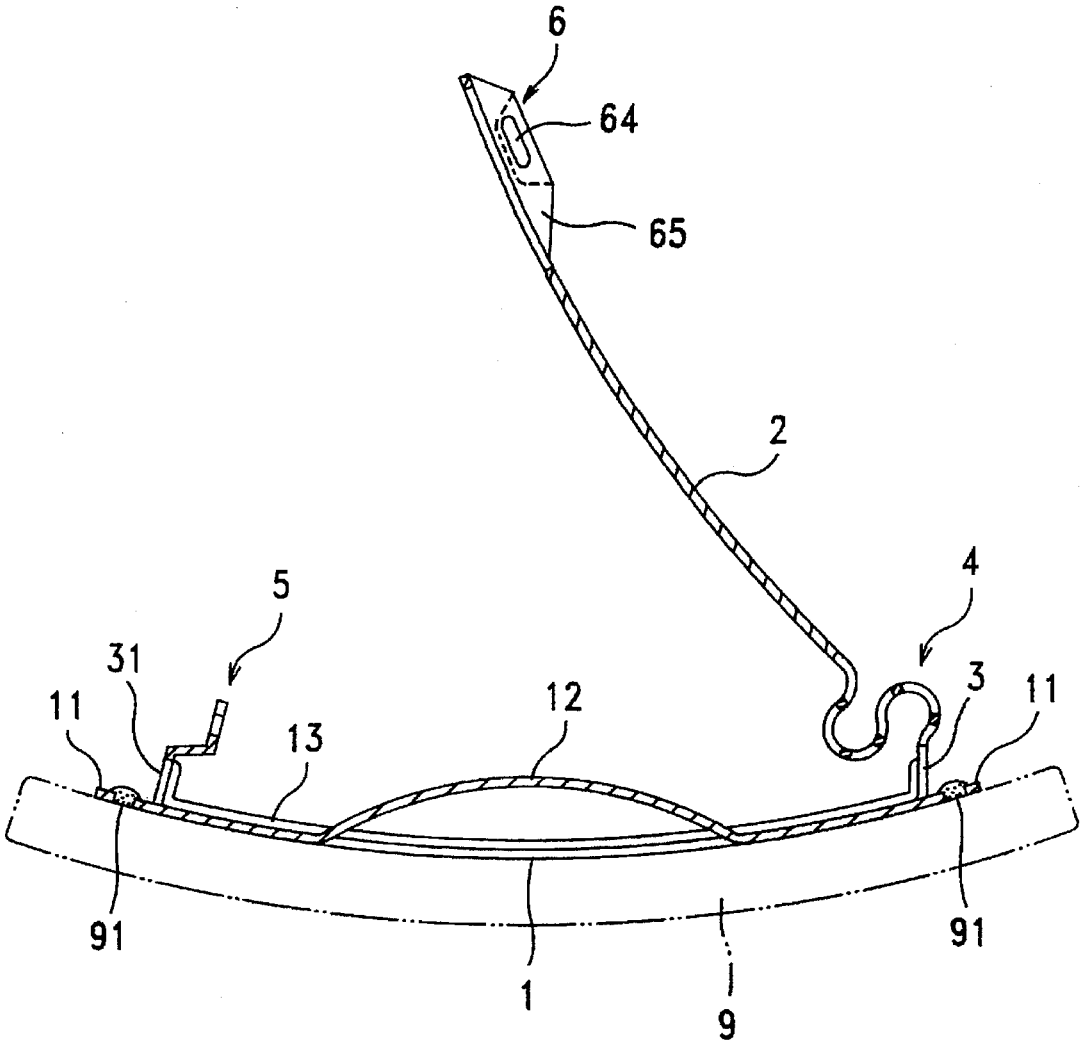
FIG. 8 is a sectional view of the hair clip shown in FIG. 7.
Figure 9:
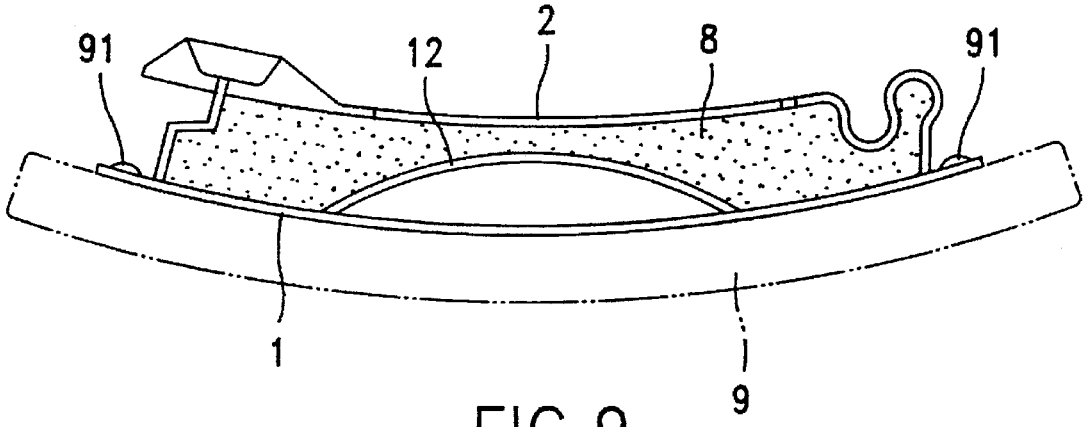
FIG. 9 is an applied view of the second embodiment of the present invention, showing the hair clip fastened to the hair.

FIGS. 7, 8, and 9 show a hair clip according to a second embodiment of the present invention. According to this embodiment, the base plate section 1 has two integral lugs 11 at two opposite ends adapted for mounting an ornamental plate 9 by fastening means 91, and an arched strip 12 longitudinally disposed in the middle for acting against the clamping plate section 2 to hold down the hair 8. Furthermore, the catch plate 5 according to this embodiment is connected to the base plate section 1 by an second upright end plate section 31; reinforcing ribs 13 are connected between the first upright end plate section 3 and the second upright end plate section 31 to prevent inward tilting of the two end plate sections 3, 31.

Figure 10:
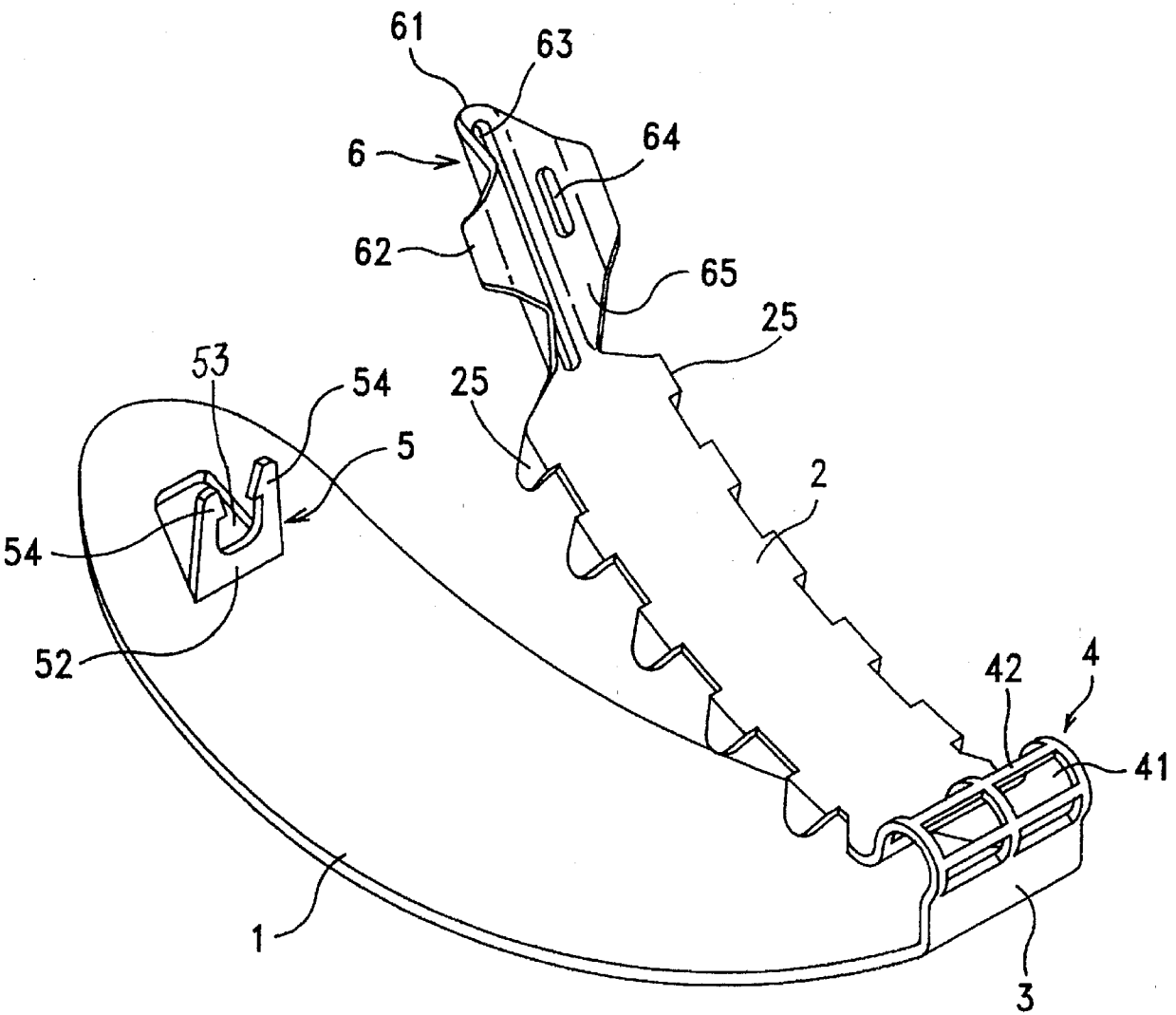
FIG. 10 is an elevational view of a hair clip according to a third embodiment of the present invention.
Figure 11:
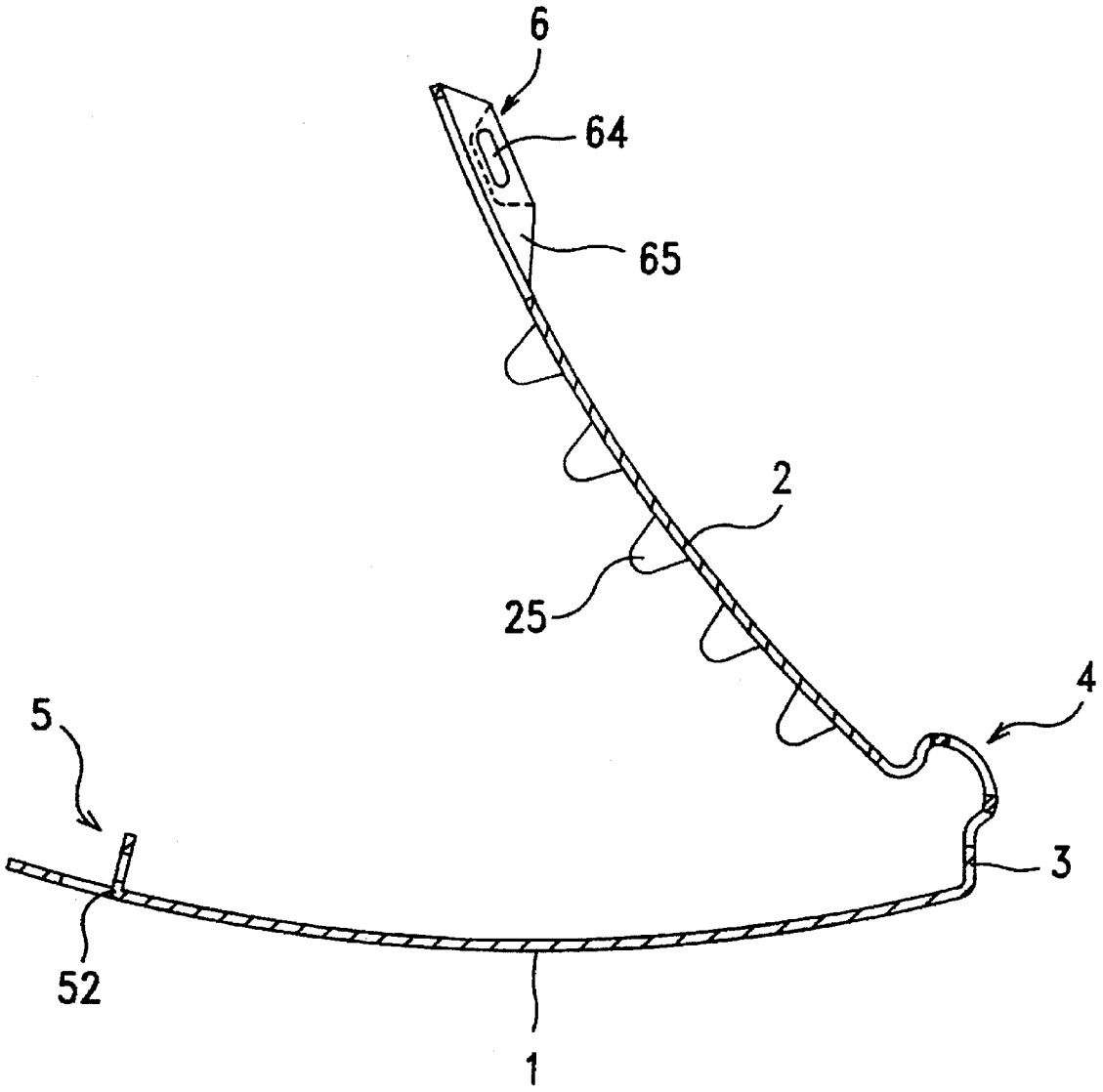
FIG. 11 is a sectional view of the hair clip shown in FIG. 10.
Figure 12:
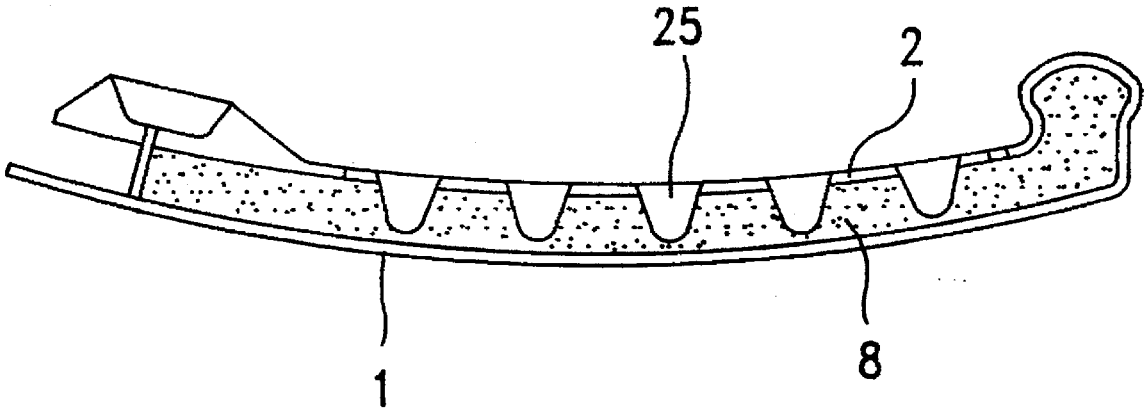
FIG. 12 is an applied view of the third embodiment of the present invention, showing the hair clip fastened to the hair.
Figure 13:
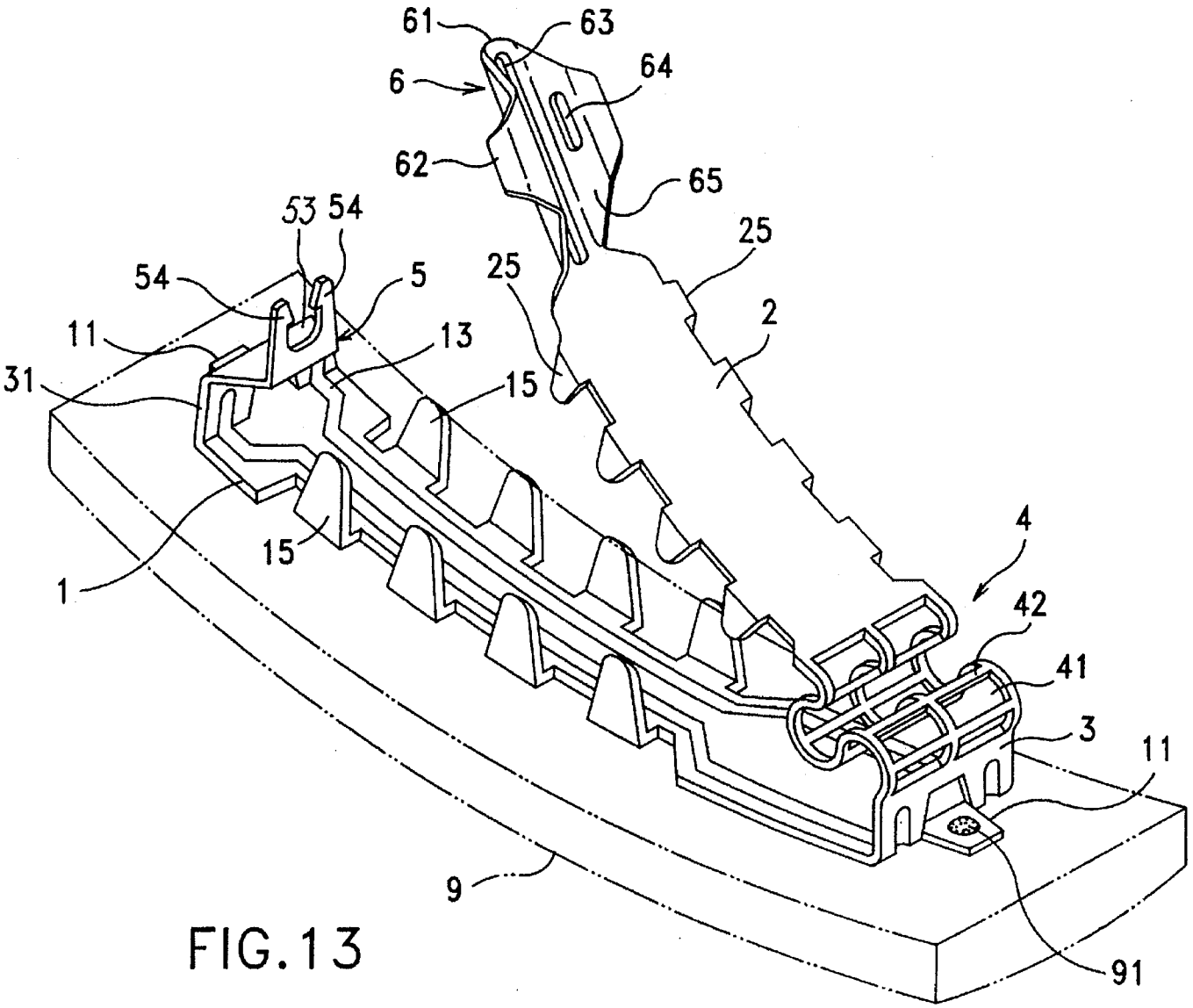
FIG. 13 is an elevational view of a hair clip according to a fourth embodiment of the present invention.
Figure 14:
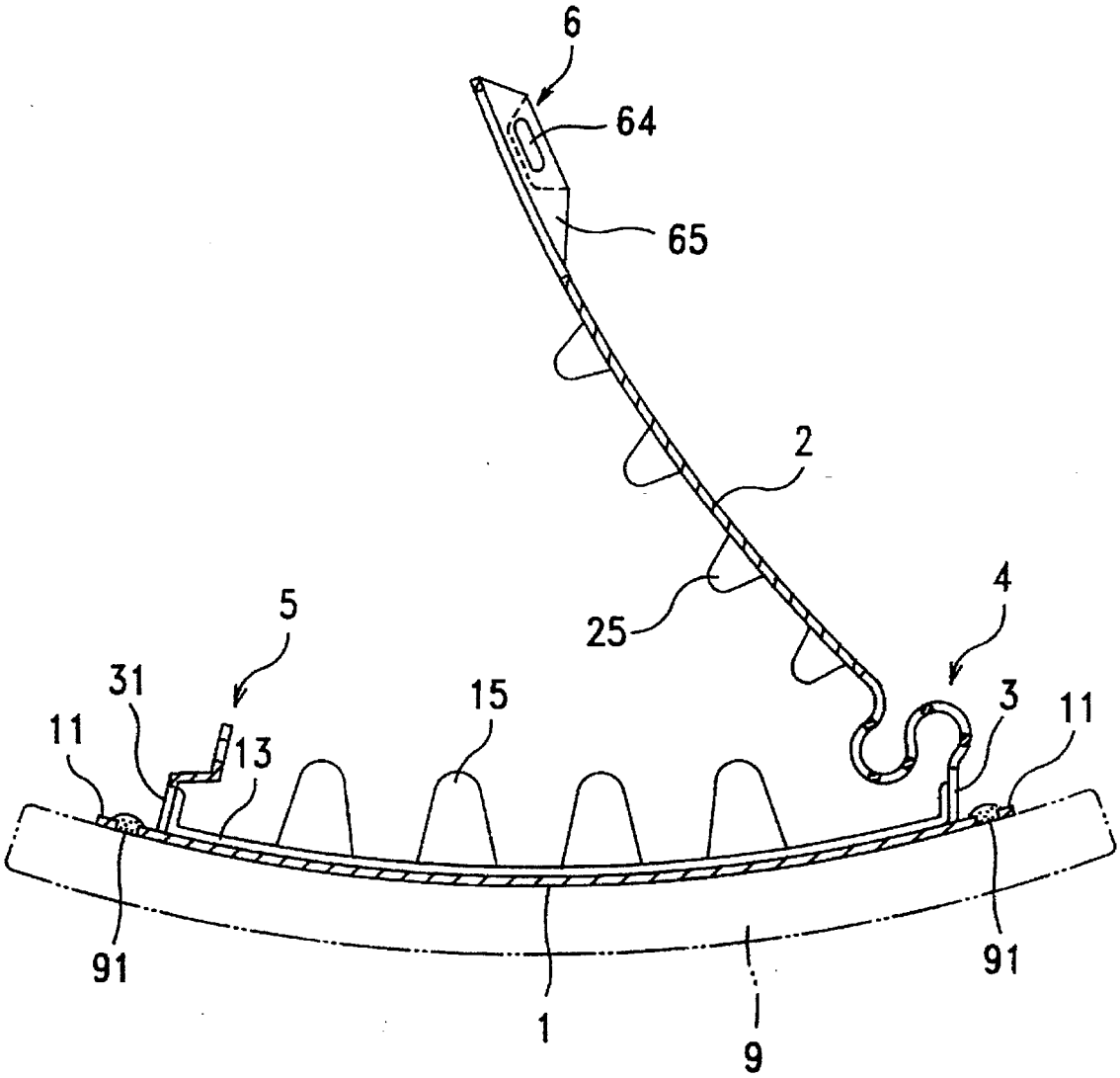
FIG. 14 is a sectional view of the hair clip shown in FIG. 13.
Figure 15:
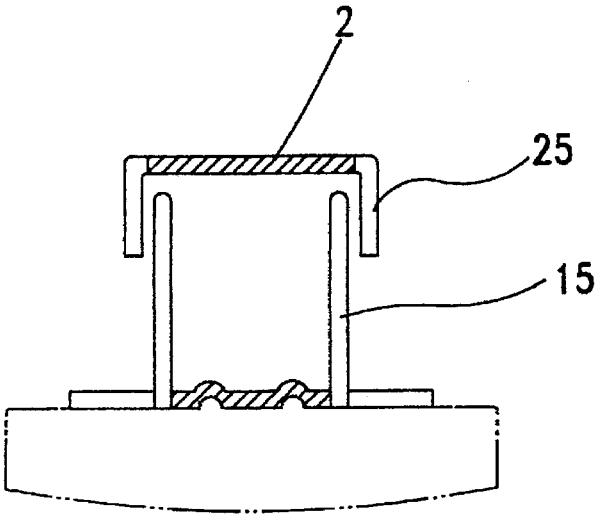
FIG. 15 is a cross sectional view of the hair clip of the fourth embodiment of the present invention when fastened up.
Figure 16:
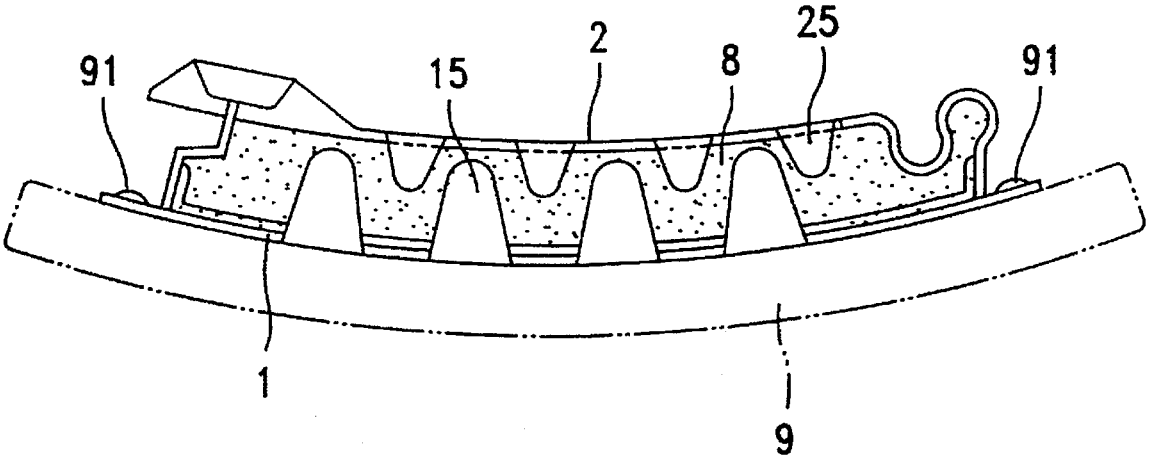
FIG. 16 is a longitudinal view in section of the fourth embodiment of the present invention, showing the hair clip fastened to the hair.

FIGS. 10, 11, and 12 show a hair clip according to a third embodiment of the present invention. According to this embodiment, the clamping plate section 2 comprises two longitudinal rows of downward teeth 25 at two opposite sides. When the hair clip is fastened to the hair 8, the hair 8 is separated into several bundles of hairs by the downward teeth 25 and held down by the clamping plate section 2 and the downward teeth 25.

FIGS. from 13 to 16 show a hair clip according to a fourth embodiment of the present invention. According to this embodiment, the clamping plate section 2 comprises two longitudinal rows of downward teeth 25 at two opposite sides; the base plate section 1 comprises two lugs 11 at two opposite ends adapted for mounting an ornamental plate 9 by fastening means 91, and two rows of upright teeth 15 longitudinally disposed at two opposite sides. The width between the two rows of upward teeth 15 is narrower than that between the downward teeth 25 and the height of the upward teeth 15 is longer than that of the downward teeth 25. Therefore, when the retaining section 6 is fastened to the catch plate 5, the upward teeth 15 are covered within the clamping plate section 2 without causing an injury to the user's hand.

It is to be understood that the drawings are designed for purposes of illustration only, and are not intended as a definition or limits of the scope of the invention disclosed.

What the invention claimed is:

1. A hair clip comprising:

a base plate section having a first end and a second end;

an upright end plate section raised from the first end of said base plate section at right angles;

a clamping plate section;

a hinge section connected between said upright end plate section and said clamping plate section;

a retaining section longitudinally extending from one end of said clamping plate section remote from said hinge section, said retaining section comprising a substantially V-shaped base wall portion, two outward finger strip portions adapted for squeezing by hand to compress said V-shaped base wall portion inward, two coupling wall portions bilaterally connected between the V-shaped base wall portion of said retaining section and said finger strip portions, each of said coupling wall portions having a retaining hole;

a catch plate raised from the second end of said base plate section, said catch plate comprising an upright base wall portion connected to the second end of said base plate section at right angles, and two substantially C-shaped pawls bilaterally raised from said upright base wall portion and adapted for engaging the retaining holes of the coupling wall portions of said retaining section, and a mouth defined between said C-shaped pawls and adapted for receiving the V-shaped base wall portion of said retaining section.

2. The hair clip of claim 1 wherein said hinge section is comprised of a plurality of intersected ribs defining a plurality of slots.

3. The hair clip of claim 1 wherein the base wall portion of said retaining section comprises an elongated slot in the middle.

4. The hair clip of claim 1 wherein said base plate section has two lugs longitudinally extending from the first end and second end thereof in reversed directions and adapted for mounting an ornamental plate.

5. The hair clip of claim 1 wherein said base plate section has reinforcing ribs longitudinally connected between the first end and second end thereof.

6. The hair clip of claim 1 wherein said base plate section comprises an arched strip longitudinally disposed in the middle for acting against said clamping plate section to hold down the hair.

7. The hair clip of claim 1 wherein said clamping plate section comprises two rows of downward teeth longitudinally disposed at two opposite sides, said downward teeth facing said base plate section when said retaining section is secured to said catch plate.

8. The hair clip of claim 7 wherein said base plate section has two rows of upward teeth longitudinally disposed at two opposite sides.

9. The hair clip of claim 8 wherein the distance between the two rows of upward teeth of said base plate is narrower than that between the two rows of downward teeth of said clamping plate section.

10. The hair clip of claim 9 wherein the height of the upward teeth of said base plate is longer that that of the downward teeth of said clamping plate section.

* * * * *